US006652016B2

(12) United States Patent
Sbabo et al.

(10) Patent No.: US 6,652,016 B2
(45) Date of Patent: Nov. 25, 2003

(54) SELF-LOCKING FORCEPS FOR RAISING A SLAB-SHAPED PRODUCT

(75) Inventors: Enrico Sbabo, Zimella (IT); Fabrizio Seghetto, Legnago (IT); Fabio Trevisan, Campiglia Dei Berici (IT)

(73) Assignee: Europromecc Engineering S.N.C. di Trevisan Fabio, Seghetto e Sbabo, Verona (IT)

( * ) Notice: Subject to any disclaimer, the term of this patent is extended or adjusted under 35 U.S.C. 154(b) by 0 days.

(21) Appl. No.: 10/013,628

(22) Filed: Dec. 10, 2001

(65) Prior Publication Data

US 2002/0089200 A1 Jul. 11, 2002

(30) Foreign Application Priority Data

Jan. 5, 2001 (IT) ..... VI2001A0007

(51) Int. Cl.[7] ..... B66C 1/44; B66C 1/48

(52) U.S. Cl. ..... 294/103.1; 294/101; 294/102.1

(58) Field of Search ..... 294/90, 101, 102.1, 294/103.1, 104, 114, 901, 902; 24/115 M, 134 R, 134 L, 136 R

(56) References Cited

U.S. PATENT DOCUMENTS

| | | | | |
|---|---|---|---|---|
| 1,121,130 A | * | 12/1914 | Rafferty | 294/102.1 X |
| 1,976,848 A | * | 10/1934 | Ham | 294/103.1 |
| 2,618,505 A | * | 11/1952 | Rosenbaum | 294/104 |
| 3,414,315 A | * | 12/1968 | O'Quinn | 294/104 |
| 3,843,186 A | * | 10/1974 | Van de Wetering | 294/102.1 |
| 4,250,734 A | * | 2/1981 | Tinsley | 24/136 R X |
| 4,273,373 A | * | 6/1981 | van de Wetering | 294/101 |

FOREIGN PATENT DOCUMENTS

| | | | | |
|---|---|---|---|---|
| EP | 0233386 | * | 1/1986 | |
| GB | 1385772 | * | 2/1975 | |
| RU | 630192 | * | 11/1978 | 294/101 |
| RU | 901233 | * | 2/1982 | 294/102.1 |
| RU | 1622280 | * | 1/1991 | 294/103.1 |

* cited by examiner

*Primary Examiner*—Eileen D. Lillis
*Assistant Examiner*—Paul T. Chin
(74) *Attorney, Agent, or Firm*—Bucknam and Archer

(57) ABSTRACT

A forceps is described which is self-locking and is used for raising slabs. It is of the type which has two jaws in hard steel which are reciprocally hinged so that they may be closed or opened with automatic locking when they come in contact with the product to be moved. The forceps is characterized by the fact that it is composed of three elements, precisely a fixed body (2), a cam (3) and a movable carriage which holds the cam, and in which the fixed jaw comes in contact in a gripping manner with the pushing force generated by the counterposed cam thus achieving in this manner the closure of the product being raised.

9 Claims, 6 Drawing Sheets

SELF-LOCKING FORCEPS FOR RAISING A SLAB-SHAPED PRODUCT

FIELD OF THE INVENTION

The present invention relates to a self-blocking forceps for raising slabs, such as plates, metallic or concrete slabs, ingots and similar products.

BACKGROUND OF THE INVENTION

In all industrial fields and in particular in the mechanical field for working metals, it is necessary to use tools, defined with the generic term forceps, capable of moving semi-worked products as sheets and capable of transporting the products from one department to another for working the products. In the building sector such sheets or slabs are made of concrete.

These types of forceps are essentially constituted by two jaws made of hard steel, which are connected one to the other in such a manner that they may be closed or opened and having their heads shaped in different manner depending upon the use for which they are intended and which are of the type called "self-blocking", that is they guarantee automatic locking when they come in contact with the product being moved.

In the present state of the art there are known many types of forceps as described in U.S. Pat. Nos. 3,843,186; 4,273,373, 4,497,201; East German Publication 276,852; G.B. 1385772, E.P. 0233386.

SUMMARY OF THE INVENTION

An object of the present invention is to provide a self-blocking forceps which is constructively simpler than similarly known devices and at a lower cost than the forceps at present in commerce.

This object is achieved by means of a self-blocking forceps composed by three items: a fixed body for the forceps, a cam and a movable carriage which carries the cam.

In more detail, the fixed body forceps which is provided with an opening for the insertion of the hook used for raising the material, has a fixed jaw which comes in contact, in an antagonistic manner with the pushing force which is generated by the counterposed cam. In this manner the closure on the material referred to hereinbelow by the generic term plate is achieved.

A further novel feature of this invention provides that the cam is mounted on the lower end of the movable carriage in an idle way and with a suitable profile so that after the cam has been manually approached to the surface of the slab, due to the manual displacement of the carriage the cam performs a very small angular rotation, which is sufficient to generate the necessary gripping force for the anchoring of the slab.

The cam has a shaped profile for the purpose of guaranteeing the anchoring of slabs of different thickness.

Still constructively this invention provides further novelty, that the movable carriage has the upper end, opposite to the end supplied with the cam and which slides within a slot formed on the fixed body, resting against a block which is integral with the fixed body, the entire device being shaped in a manner that the carriage becomes self-blocking under the weight of the material due to the pushing action of the cam when the latter is in a position of anchoring the slab.

BRIEF DESCRIPTION OF THE DRAWINGS

The invention will be better understood by reference to a possible embodiment provided as a non-limiting illustration, by means of the drawings of which.

DETAILED DESCRIPTION OF THE INVENTION

Figure 1:
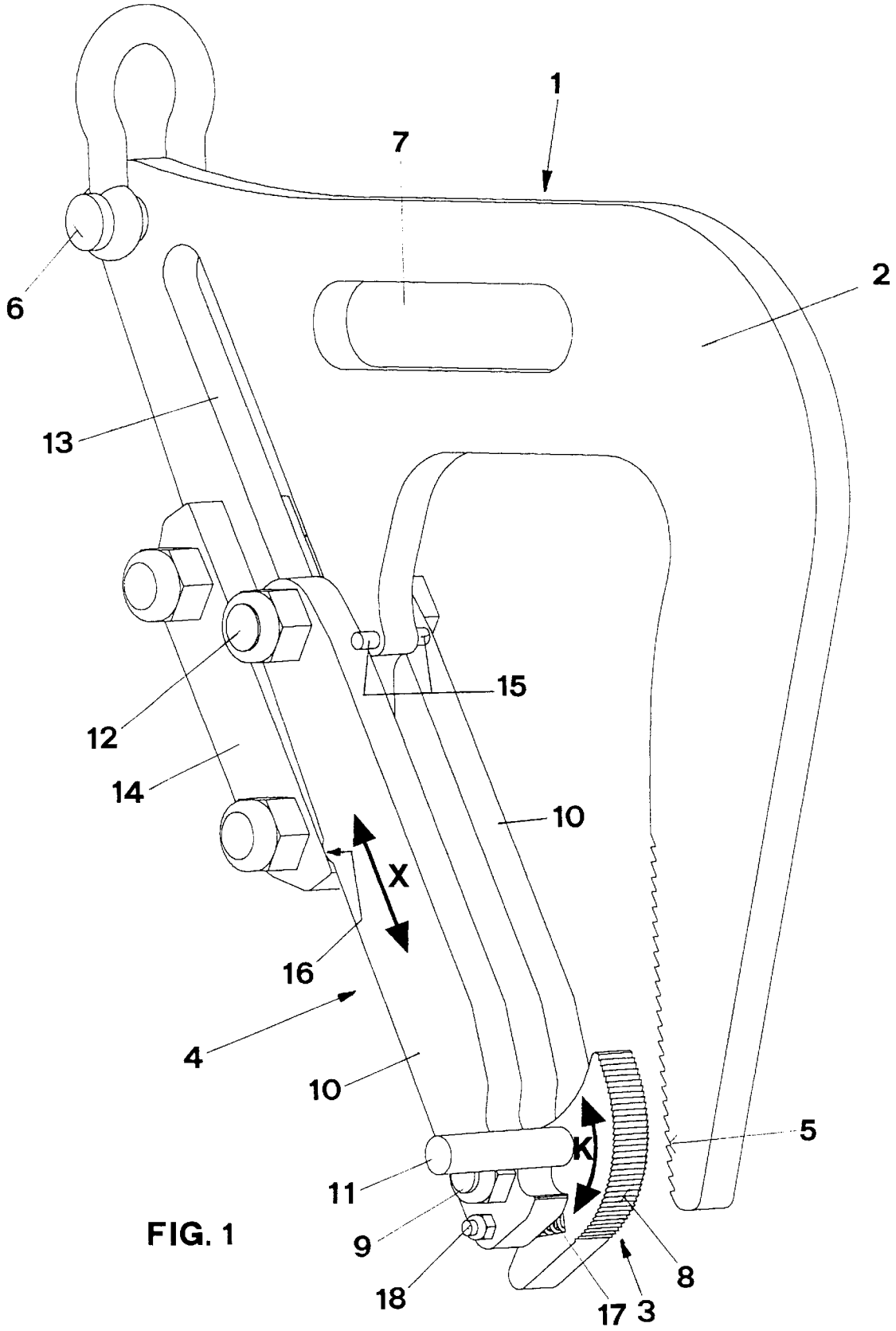
FIG. 1 shows a perspective view of the forceps of this invention.
Figure 3:
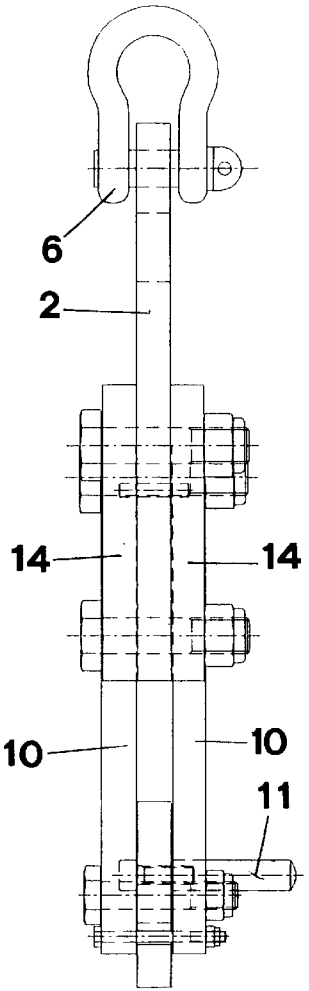
FIGS. 2, 3 and 4 show respectively a front view, a side view and a view in cross section according to line IV—IV of the forcep of FIG. 2.
Figure 2:
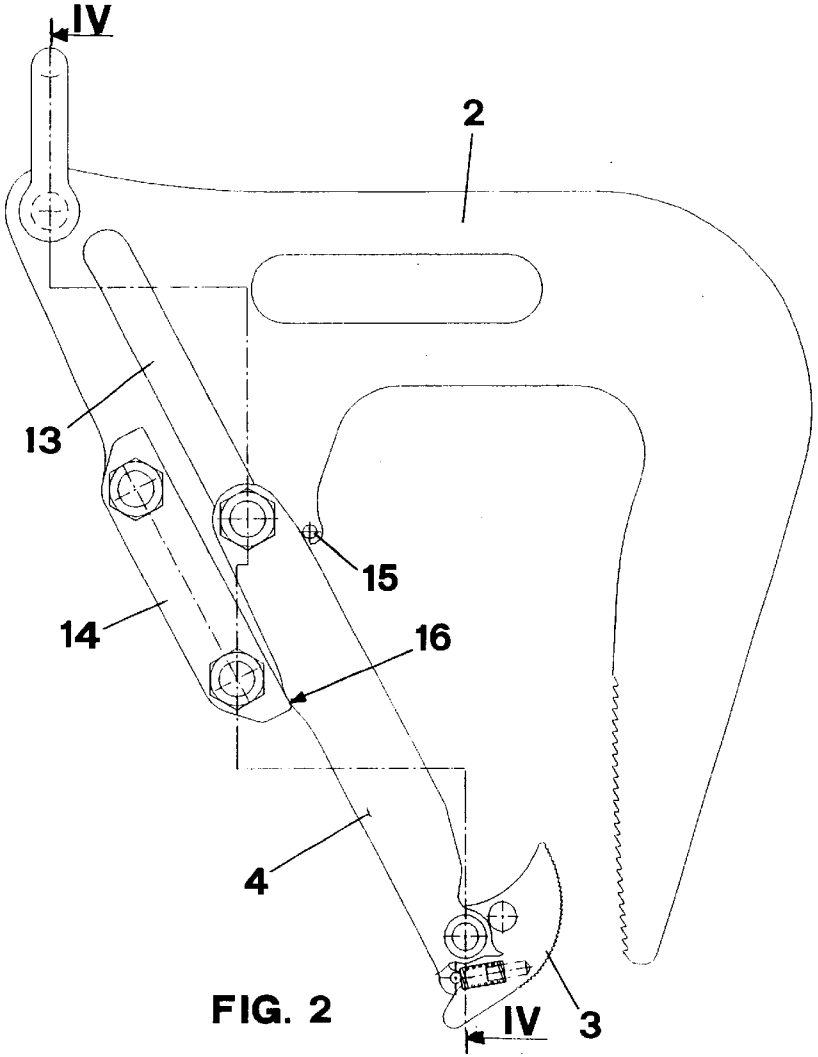
Figure 4:
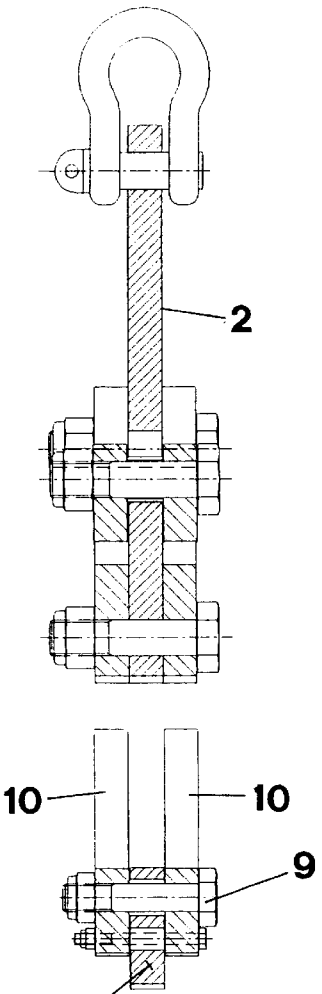

As shown in FIG. 1 the forceps (1) essentially is constituted by a fixed body (2), cam (3), and movable carriage (4) which holds the cam (3).

On the fixed body (2) are disposed the fixed jaw (5), provided with a toothed face, which is fixed with respect to the raising eye (6) and the opening (7) for the grip and transportation of the device.

Cam (3) provided with the shaped profile (8) which has a toothed face, constitutes the movable jaw of the forceps and is keyed in an idle way with pin (9) at the lower end of carriage (4).

The carriage (4) is constituted by a pair of flat segments (10) between which the cam is bordered, and is bound to slide with the upper end by means of piston pin (12) within the lozenge (13) disposed on the fixed body (2) and is kept in guide between block (14) and peg (15), both of which are integral with the body (2).

Advantageously, carriage (4) rests and slides on the upper planar surface of block (14) keeping a substantially punctiform contact formed with shaped tooth (16) shaped on the carriage.

Still advantageously, cam (3) is provided with peg (11) which has the function of limiting the rotation of the cam and at the same time it functions as a grip due to the manual displacement of the carriage and the cam in the position of the upper dead center as shown in FIG. 7*a*.

Further, cam (3) is provided with a spring (17), attached on fixed element (18) which performs the function of keeping the elastic cam in an intermediate position shown in FIG. 7*b*, preventing the cam from positioning in the lower dead center shown in FIG. 7*c*, which is functional.

Figure 7:
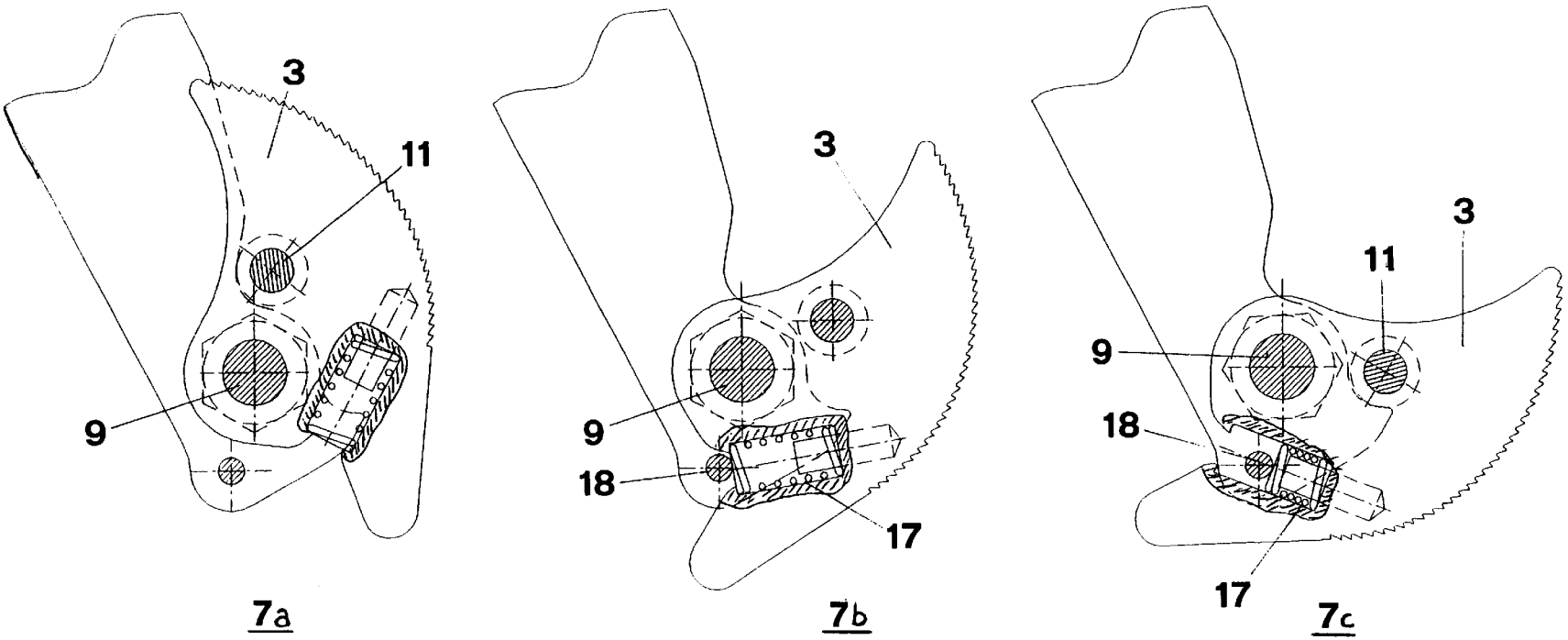
FIG. 7 is a view in detail of the lower end of the movable carriage with the cam in three different positions.
Figure 9:
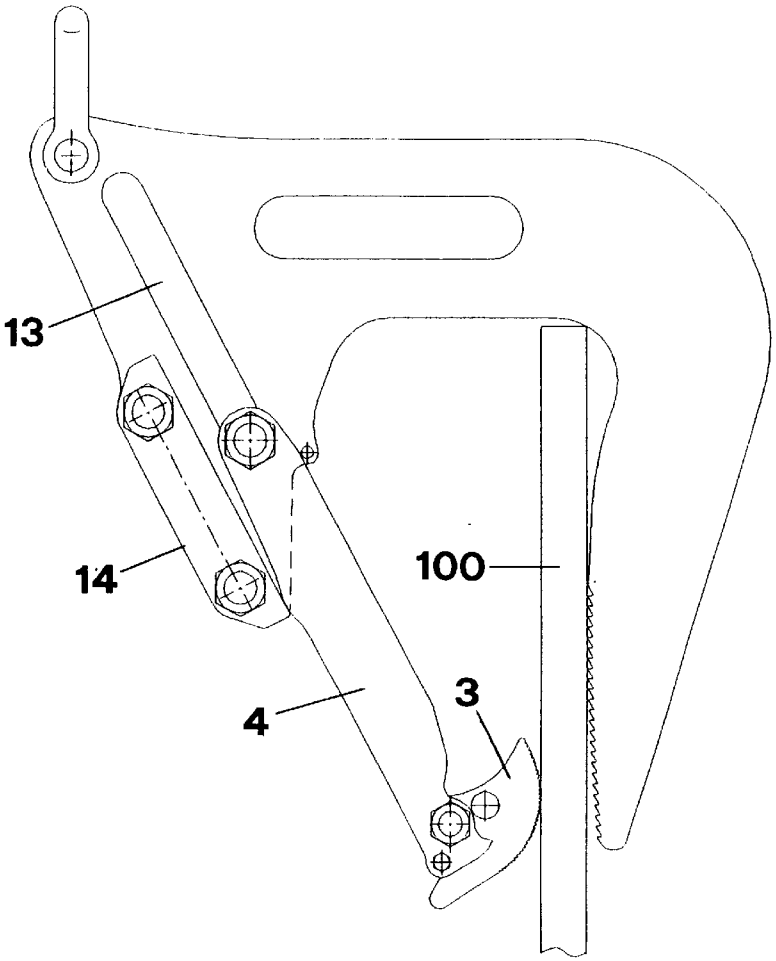
FIGS. 8 and 9 show two anchored positions of the forceps with the sheet of different thickness.
Figure 8:
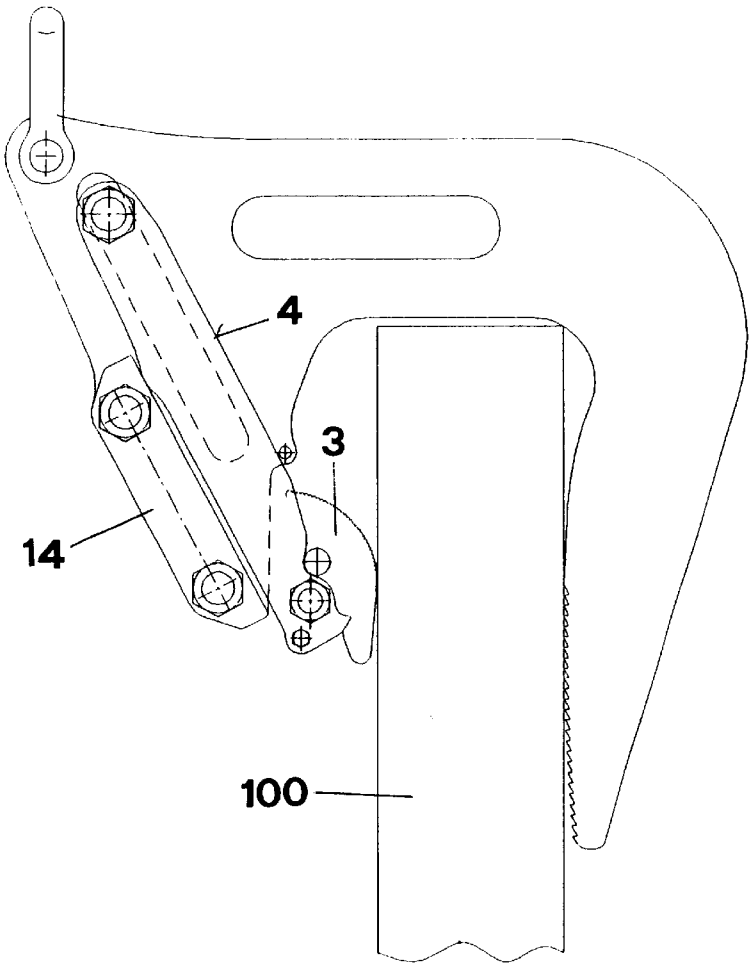
Figure 10:
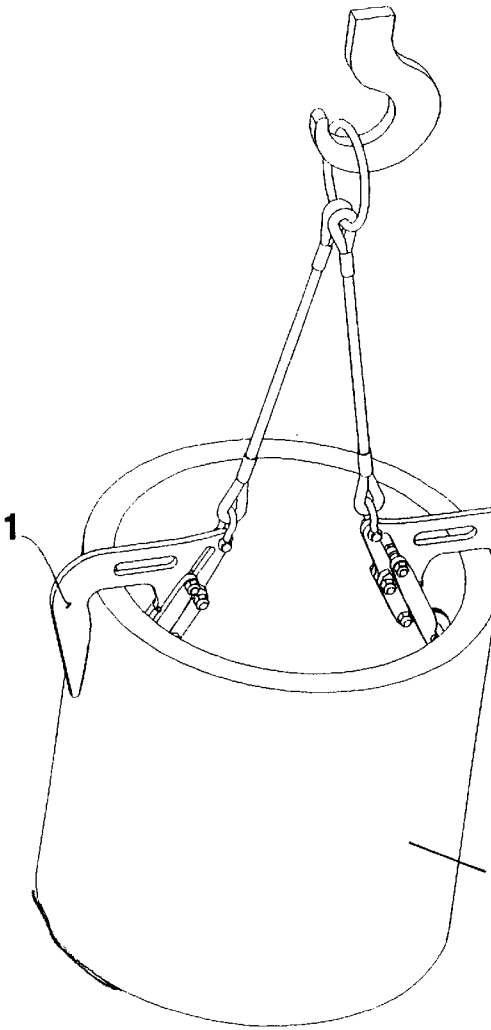
FIGS. 10, 11 and 12 illustrate different manners of use of the forceps of the present invention.
Figure 11:
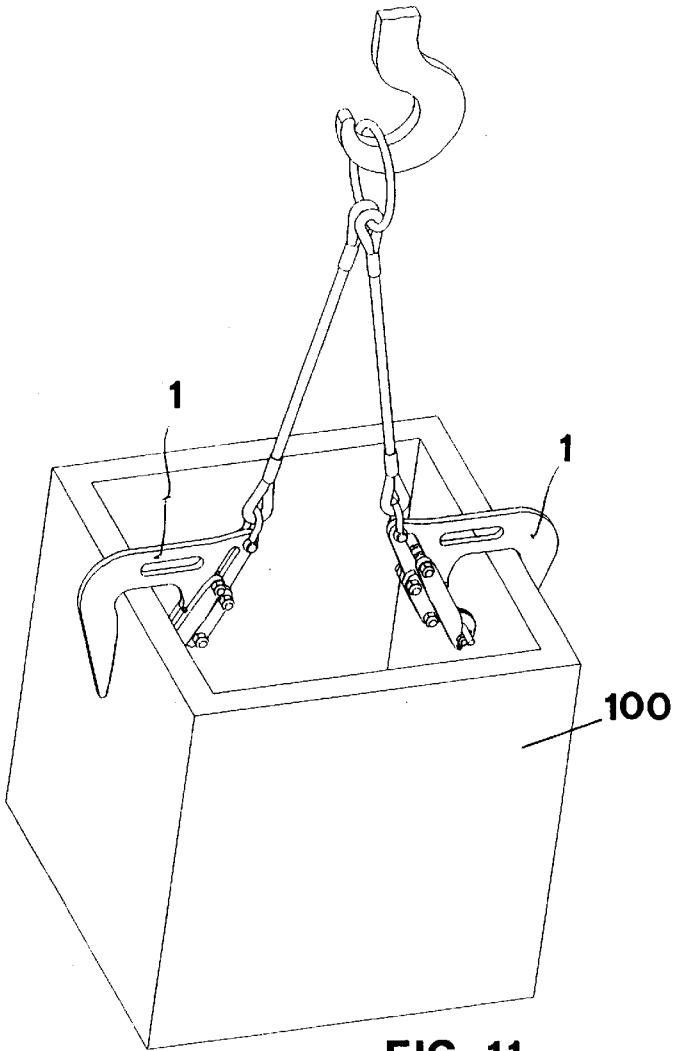
Figure 12:
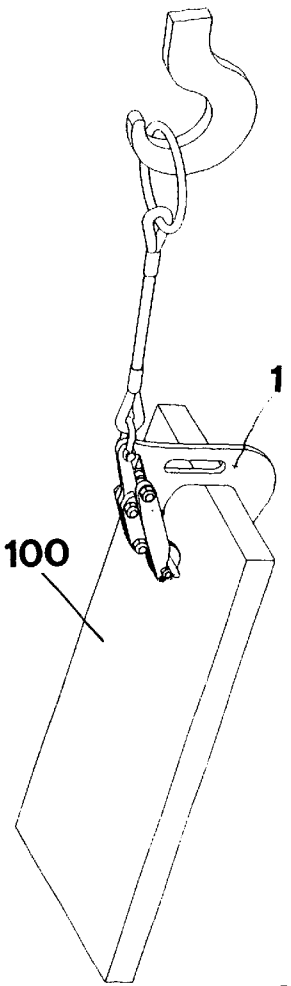

As shown in FIGS. 1, 7 and 8, the functioning of the forceps is achieved due to the articulated raising carriage/cam which performs two motions, first a linear displacement of the carriage according to arrow "X" to approach cam (3) to slab (100) and subsequently, automatically, the angular rotation of the cam, according to arrow "K", with which the gripping force on the slab is generated.

Figure 6A:
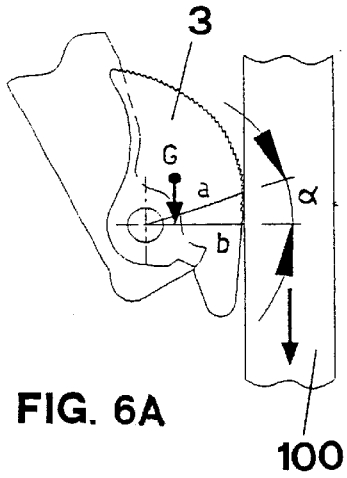
FIGS. 5 and 6 show the forces which act on the forceps of the invention when the forceps is in a position of anchoring of the sheet.
Figure 6B:
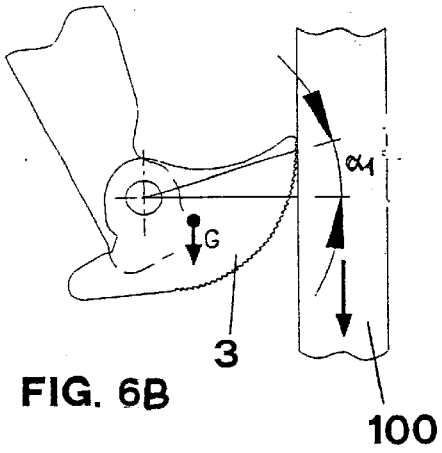
Figure 5:
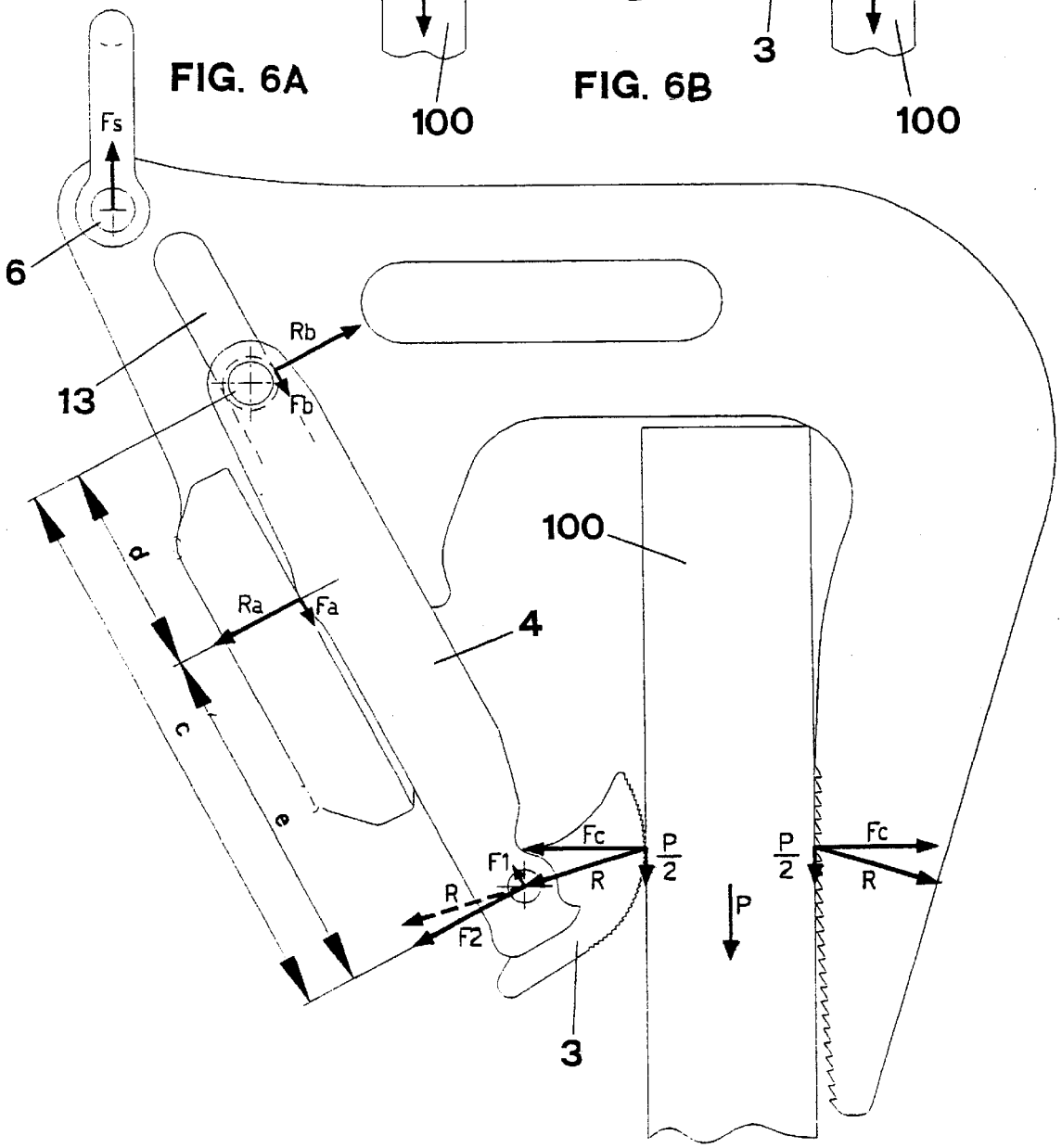

The stationary block of the forceps on the slab is guaranteed by the interplay of the forces shown in FIGS. 5 and 6. The particular position of the center of gravity "G" of cam (3) with respect to its rotation pin (9) operates in a manner that the cam (3) rotates due to gravity towards the slab (100), resting on the slab and therefore blocking the slab with a force of closure "Fc" directly proportional to the load "P" which must be raised. This force is increased due to the difference between the direction of the force of raising "Fs"

applied in the raising eye (6) and the direction of the weight "P" of slab (100).

As shown in FIG. 5, the entire carriage (4) becomes self-blocking under the load and remains in position because the pushing action of the force "F1" generated by the cam is conflicting with the action of the two forces "Fa" and "Fb" which always act on the carriage and which have a direction opposite to force "F1".

The two forces "Fa" and "Fb" are generated by the binding reactions due to friction respectively "Ra" and "Rb" resulting from the force "F2" applied on pin (9).

The blockage of the carriage which occurs when the relation (Fa+Fb)>F1, requires a well defined dimensioning of the length of the arms of the lever "c", "d" and "e".

Advantageously these three arms are defined by the rigid structure of the carriage so that they remain constant even when the thickness of the slab varies and therefore also the binding actions discussed hereinabove do not vary.

As shown in FIG. 6, the ratio which exists between the force of closure and the weight of the load of material to be raised is in function of the contact angle "$\alpha$" defined by the two straight lines which intersect the hinge point of the cam, which lines are respectively directed, one line "a" towards the point of contact on the slab and the other, line "b" perpendicular to the slab.

Under the laws of mechanics, the width of the angle "$\alpha$" must be lower than the width of the angle "B", the latter being a function of the coefficient of friction "$\rho$" which is related to the materials which constitute the cam and the slab, according to the known relationship $\rho$=tangent $\beta$.

The invention provides that the trend of the profile of the cam is conformed in a manner that the angle of contact "$\alpha$" remains essentially constant independently from the variation of the orientation of the cam in the closure position that is always having the equivalency $\alpha \cong \alpha 1$ (see FIG. 6).

On the basis of what has been described hereinabove the advantages of the invention are:

1) it allows easy anchorage because it is only necessary to approach the cam to the wall of the slab by manual displacement of the carriage;
2) automatic blocking occurs under the load without requiring the intervention of the operator;
3) it allows to anchor slabs of different thickness within a wide range;
4) it allows the grip of slabs with reduced cluttering from one side, because the mechanisms of regulation of the forceps are disposed only on one side.

Obviously several embodiments different from the described embodiment are possible depending upon the dimensions and the profile of the forceps without departing from the scope of the attached claims.

What is claimed is:

1. A self-locking forceps for raising a slab-shape product, said self-locking forceps having a pair of oppositely disposed steel jaws, one of which is fixed and the other movable, adapted to automatically grip and release the product therebetween, said self-locking forceps comprising:

a) a fixed body (2) having a raising eye (6) and an opening (7) for gripping the self-locking forceps for movement;

b) a fixed jaw (5) arranged on said fixed body;

c) a movable carriage (4) oppositely disposed on said fixed body adjacent said fixed jaw and adapted to be guided on said fixed body angularly downwardly towards said fixed jaw by means of engagement of movable carriage (4) with a slot (13) formed in said fixed body;

d) a movable jaw having a cam shaped profile (3) pivotally mounted on said movable carriage at a lower end thereof opposing said fixed jaw;

e) a block (14) integral with said fixed body and having a planar surface adjacent said slot so as to support said movable carriage thereon, and f) a first peg (15) disposed adjacent said slot opposite from said block (14), so that said movable carriage is guided along said slot between said block (14) and first peg (15), whereby said movable jaw can be approached to said fixed jaw (5) so as to contact and grip there-between the product by manually displacing movable carriage (4) towards said fixed jaw (5).

2. The self-locking forceps according to claim 1, wherein said movable jaw and said fixed jaw are provided with toothed faces.

3. The self-locking forceps according to claim 1, wherein said movable carriage has a tooth (16) formed thereon in supporting contact with the planar surface of said block (14).

4. The self-locking forceps according to claim 3, wherein said movable jaw has a center of gravity positioned with respect to the pivotal mounting on the movable carriage such that the movable jaw rotates due to gravity towards the slab-shaped product disposed between the fixed jaw and the movable jaw so as to contact the slab-shaped product and lock thereagainst with a force of closure ($F_c$) directly proportional to a weight (P) of the product.

5. The self-locking forceps according to claim 4, wherein the direction of raising force ($F_s$) applied to raising eye (6) is different than the direction of the weight (P) of the product.

6. The self-locking forceps according to claim 5, wherein said movable carriage becomes locked in position under load because a force (Fl) generated by the movable jaw on the pivotal mounting thereof in the direction of movement of said movable carriage opposes the combined action of a force (Fa), resulting from the binding reaction (Ra) due to friction between tooth (16) and block (14), and a force (Fb), resulting from the binding reaction (Rb) due to friction of the engagement of said movable carriage (4) and slot (13), wherein binding reaction (Ra) and binding reaction (Rb) result from a force (F2) applied at the pivotal mounting of said movable jaw on said movable carriage perpendicular to the direction of movement of said movable carriage.

7. The self-locking forceps according to claim 1, wherein said movable jaw is provided with a second peg (11) which limits the rotation of said cam shaped jaw to a top dead center position and provides a grip for the manual displacement of said movable carriage (4).

8. The self-locking forceps according to claim 1, wherein said movable jaw is provided with a spring (17) which contacts an element (18) integral with said movable carriage so as to maintain said movable jaw in an intermediate position and preventing the cam shaped jaw from taking a bottom dead center position.

9. The self-locking forceps according to claim 1, wherein the cam-shaped profile of the movable jaw is such that an angle of contact "$\alpha$" of the movable jaw with the slab-shaped product being raised remains substantially the same independent of the orientation of the movable jaw in a closure position.

* * * * *